US006796055B2

(12) United States Patent
Baltes

(10) Patent No.: US 6,796,055 B2
(45) Date of Patent: Sep. 28, 2004

(54) METHOD AND DEVICE FOR THE NON-IRON DRYING OF DAMP MATERIAL, IN PARTICULAR DAMP LAUNDRY

(75) Inventor: Hans Baltes, Fröndenberg (DE)

(73) Assignee: Heinz Szelies, Essen (DE); part interest ( * ) Notice: Subject to any disclaimer, the term of this patent is extended or adjusted under 35 U.S.C. 154(b) by 0 days.

(21) Appl. No.: 10/312,604

(22) PCT Filed: Jun. 18, 2001

(86) PCT No.: PCT/DE01/02219

§ 371 (c)(1),
(2), (4) Date: Apr. 7, 2003

(87) PCT Pub. No.: WO02/00990

PCT Pub. Date: Jan. 3, 2002

(65) Prior Publication Data

US 2004/0064966 A1 Apr. 8, 2004

(30) Foreign Application Priority Data

Jun. 28, 2000 (DE) ..... 100 30 531

(51) Int. Cl.[7] ..... F26B 3/00

(52) U.S. Cl. ..... 34/449; 34/321; 34/604; 34/606

(58) Field of Search ..... 34/321, 327, 425, 34/449, 552, 604, 606

(56) References Cited

U.S. PATENT DOCUMENTS

| | | | | |
|---|---|---|---|---|
| 4,180,919 A | * | 1/1980 | Baltes | 34/449 |
| 4,625,432 A | * | 12/1986 | Baltes | 34/621 |
| 4,869,872 A | | 9/1989 | Baltes | |
| 5,228,211 A | | 7/1993 | Stubbing | |
| 5,433,919 A | | 7/1995 | Baltes | |
| 6,161,306 A | * | 12/2000 | Clodic | 34/321 |
| 6,585,781 B1 | * | 7/2003 | Roseen | 8/149.1 |

FOREIGN PATENT DOCUMENTS

| | | |
|---|---|---|
| DE | 36 32 820 | 4/1988 |
| DE | 42 35 560 | 4/1994 |
| EP | 0 094 356 | 11/1983 |

* cited by examiner

*Primary Examiner*—Ira S. Lazarus
*Assistant Examiner*—Kathryn S. O'Malley
(74) *Attorney, Agent, or Firm*—Collard & Roe, P.C.

(57) ABSTRACT

The invention describes a method for the drying of a damp material (2), whereby the material (2) is treated in a treatment chamber (15) of a drying cabinet (1) in a mechanically immobile condition, in which air (10) is directed through the treatment chamber (15) and over a condenser (13) and the moisture in the air (10) can condense at the condenser (13) and be led away. The air (10) is led about the material (2) for drying at least during a period of the drying of the material (2) in a closed loop through the treatment chamber (15) in which the material (2) at increasing temperature in the treatment chamber (15) is exposed to steam or increased humidity generated at least partly from the dampness of the material (2) or the increased humidity of the air (10) circulating around and is relaxed and smoothed by the steam or the increased humidity in relation to creases, folds or similar from preceding treatments, and with an increasing dehumidify of the residual humidity of the air (10) after the beginning of the condensation at the condenser (13) the material (2) then is freed from creases, folds or similar and therefore is then dried largely without ironing. Further the invention describes a drying cabinet (1) for the drying of the damp material (2) is treated in a treatment chamber (15) of a drying cabinet (1) in mechanically immobile condition which shows flaps (21, 22) to be switched between the circulation in the closed circulation and a treatment in the open circulation which make possible an introduction and exhausting from external air.

8 Claims, 5 Drawing Sheets

Figure 1:
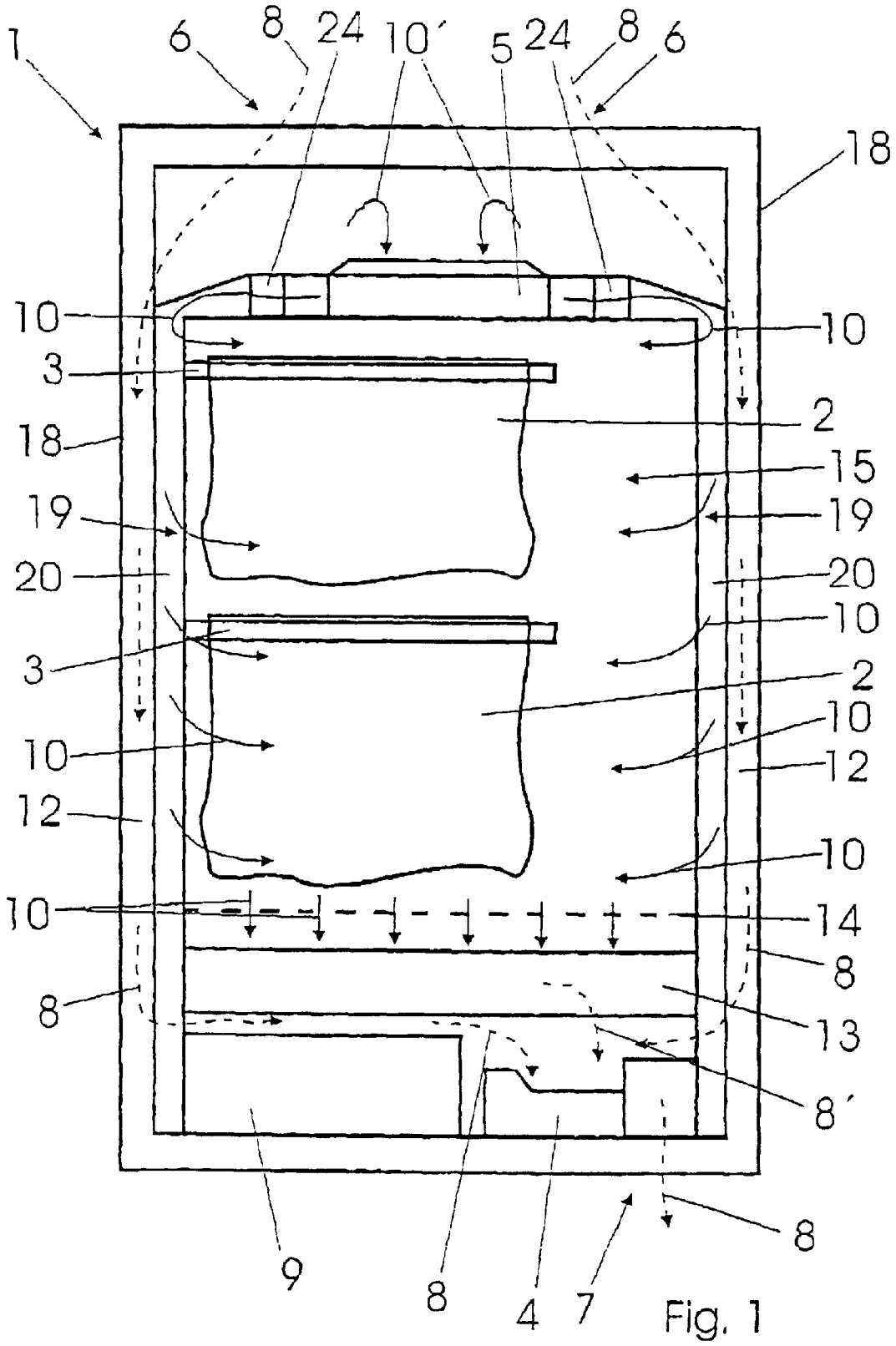

METHOD AND DEVICE FOR THE NON-IRON DRYING OF DAMP MATERIAL, IN PARTICULAR DAMP LAUNDRY

CROSS REFERENCE TO RELATED APPLICATIONS

Applicant claim priority under 35 U.S.C. §119 of German Application No. 100 30 531.8, filed Jun. 28, 2000. Applicant also claims priority under 35 U.S.C. §365 of PCT/DE01/02219, filed Jun. 18, 2001. The International application under PCT article 21(2) was not published in English.

DESCRIPTION

The invention concerns to a method and devices for the drying of damp material, in particular of damp laundry, according to the generic part of the claim 1 or the claim 13.

The drying of laundry is a problem solved many times by means of different technological facilities. Besides the pure passive drying in the house or at the fresh air at present mainly so-called drum dryers are used for this, into which the laundry to be dried is entered after the stage of washing and is then pressurized with warm air under heating and simultaneous mechanical rotary movement. In these drum dryers the laundry is subject to a great mechanical load at simultaneously high temperatures, by which as a rule the laundry fibers are damaged strongly. Through this it comes to felting of the clothes and shrinking of the laundry pieces, whereby the laundry altogether can get useless. Drying the laundry in drum dryers is therefore problematic and also leads at a proper treatment of the laundry in the drum dryer at a frequent repetition to the reduction of the laundry quality.

Furthermore it is known for example from DE 42 35 560 C2 to arrange a drying cabinet so that inside hanging laundry can be dried by means of a warm air blast in a gentle way and without mechanical load. The laundry pieces are brought in in hanging order and dried by warm air supplied from the outside in such a drying cabinet. By this the mechanical load of laundry is reduced to zero when drying, though an operation of such a drying cabinet is only possible, if the warm air, escaping from the drying cabinet and provided with high humidity, is lead to the output air guide to the open.

It is therefore known from DE 36 32 820 C2 to equip such a drying cabinet with a condenser, which cools down the air circulating in the closed circulation within the drying cabinet so much that the humidity condenses and can be led away into corresponding on-catch container. Through this a drying is made possible also without a corresponding removal of humid air, also the required energy quantity is smaller for heating the drying cabinet. Though the laundry will keep the crinkle remained after hanging up or the existing creases during this drying process, so that laundry taken dryly from the drying cabinet must than still be ironed. A part of the possible rationalization of the housework obtained by using the drying cabinet is given away.

It is therefore the object of the present invention to develop a drying cabinet or a method for drying in such a manner, that the laundry is dried if possible without afterwards necessary ironing and an operation of the drying cabinet is also possible without an additional output air guide.

The solution of the object according to the invention corresponding to the method arises from the characterising features of claim 1 in interaction with the features of the pre-characterising part. Further advantageous developments of the invention arise from the dependent claims.

The invention starts out from a method for the drying of a damp material, in particular of a damp laundry, whereby the material is treated in a treatment chamber of a drying cabinet in mechanically immobile condition in which air is directed through the treatment chamber and over a condenser, which is cooled by an outer air circuit, and the moisture contained in the air condenses on the condenser and can be led away. This generic method is developed further by the fact that the air is circulated over the still damp material for drying at least during a period of the drying of the material with a switched-off condenser in a closed loop through the treatment chamber in which the pre-smoothed material at increasing temperature in the treatment chamber is exposed to steam or increased humidity generated at least partly from the dampness of the material or the increased humidity of the air circulating around with a temperature up to between 90 degrees Celsius and 125 degrees Celsius and is relaxed. and smoothed by the steam or the increased humidity in relation to creases, folds or similar from preceding treatments. By this with an increasing dehumidify of the residual humidity of the air after the beginning of the condensation at the condenser the material is freed of creases, folds or the like and is dried without ironing. The treatment of the material works as in the case of a steam shower by means of tension release of the fibres of the material by which creases, folds or the like form themselves gradually back as in the case of a steam shock of an iron and the material is thus then dried in a smooch state. Therefore a separate ironing treatment after drying gets superfluous, a great time-saving is attainable through that. By the production of the steam or the increased humidity from the dampness out of the material itself when brought in the advantage is obtained that this humidity is already withdrawn from the material and hereby a drying of the material walks along. Therefore in the phase of on-heating of the treatment chamber essentially only the charging of the treatment chamber with heat is necessary, the charging with steam from an external source must not be carried out. A particularly good relationship of removal of creasing regions and folds related to the drying time can be obtained, if the maximum temperature of air and/or steam or increased humidity during the phase of the transition of the steam or the increased humidity over the material inside the treatment chamber amounts between 90 and 125 degrees Celsius.

A first advantageous arrangement of the method provides that during the formation of the steam or the increased humidity the temperature is increased in the treatment chamber. Through this the steam or the increased humidity is won from the residual dampness of the material by evaporating or vaporizing the residual dampness and changing it into the air circulating in the treatment chamber. The circulating air can contain different quantities of humidity or of steam in dependence of the temperature so that at the rise of the temperature a considerable quota of the rest dampness of the material already changes into the circulating air. The drying effect of the material walking along with this at simultaneous generation of the steam needed for the elimination of creases and folds increases the economic efficiency of the method by reduction of the energy costs.

Another advantageous arrangements of the method provides that the condensation starts after a time delay after the beginning of the drying and the generation of the steam or the increased humidity. By this fact it can be obtained that just at the beginning of the drying a volume steam made replete with very much steam or increased humidity circulates through the treatment chamber which reliably removes the creases and folds of the material.

It is particularly advantageous if the change-over from the transition of the steam or the increased humidity over the material in the closed circulation to the phase of the increasing withdrawal of the air humidity from the treatment chamber by means of condensation at the condenser is carried out slidingly. By this a particularly gentle treatment of the material in the treatment chamber for a safe removal of the creases and folds can be combined with a drying phase starting gently, which allows a safe removal of the creases and folds at a simultaneously good and gentle drying of the material.

Furthermore it is conceivable that the steam or the increased humidity is at least partly supplied also from an external source to the treatment chamber. By this additional steam or a larger quantity of steam can be supplied to the material in shorter time by means of the external source without the production of steam or increased humidity being able to lead to a damage done to the material in the inner of the treatment chamber due to a high temperature supply.

Another improvement in the use of a drying cabinet according to invention can be obtained if after the phase of the transition of the steam or the increased humidity and at or after the drying the material is exposed in the same treatment chamber in an open circulation under influence of external air supplied from the outside to a further treatment like a further drying, a disinfection, a sterilization, a pollutant removal or the like. By this in the same treatment chamber the drying treatment with the obtainment of a non-iron drying of the material can be with further perhaps necessary steps of the treatment of the material as well as disinfecting the material in hospitals or perhaps a removal of pollutants at production fresh objects for example. For such combination treatments the material then doesn't have to be reloaded any more from the treatment chamber into another device but can remain in the treatment chamber and be given further treatment there directly. The treatment in the open circulation is always necessary if e.g. volutile constituents shall be removed from the material or a process sequence in the closed circulation would cause two great loads of the material.

By the addmix of external air into the treatment chamber the temperature can be reduced in the treatment chamber so that in addition to the possible further treatment of the material in the open circulation a shorter cooling from the drying phase is also attainable.

Furthermore the invention describes a drying cabinet for the execution of the method according to claim 1. which shows a treatment chamber lockable relative to the surrounding by which air with steam or increased humidity can be guided in a closed circulation and over a condenser and the humidity contained in the air condenses at the condenser and can be carried away into an on-catch container whereby the condenser can be cooled by a cooling stream of air which is drawn in from the external air.

Furthermore it can be provided that the cooling steam of air can be guided between the outside wall of the treatment chamber and the outside wall of the drying cabinet for cooling the outside wall of the drying cabinet against thermal pollutions coming from the treatment chamber.

The air with steam or increased humidity guided in the closed circulation through the treatment chamber and over the condenser can also be injectable in the form of colliding air steams into the treatment chamber by means of lateral opening arranged in opposite walls of the treatment chamber and can be deductible from the treatment chamber again sub-sided of the treatment chamber. By this a material mixture of the inside of the treatment chamber is obtainable which leads to a high absorption of the dampness of the material by the air.

Furthermore the invention describes a drying cabinet for the drying of a damp material, in particular. of a clamp laundry, for the execution of the method according to claim 1 in which the material is treated in a treatment chamber in mechanically immobile condition in which air is led in a closed circulation through the treatment chamber and over a condenser and the humidity contained in the air condenses at the condenser and can be led away. Such a drying cabinet shows flaps at the drying cabinet to be switched related to the operation of the drying cabinet between the circulation in the closed circulation and a treatment in the open circulation which make possible an introduction and exhausting of external air to or from the treatment chamber. In a further development the flaps can open and close time and/or temperature controlled and/or state dependent of the drying state of the material. Such an arrangement of the drying cabinet makes possible a combined and automated operation mode both in the closed circulation and in the open circulation and offers therefore different usage possibilities of the same device. So it can be avoided, that for example for the disinfection or sterilization a separate device must be bought since a disinfection or sterilization normally takes place in the open circulation, but the drying according to the invention in the closed circulation.

A particularly preferential embodiment of the drying cabinet according to the invention is shown the drawing.

Figure 2:
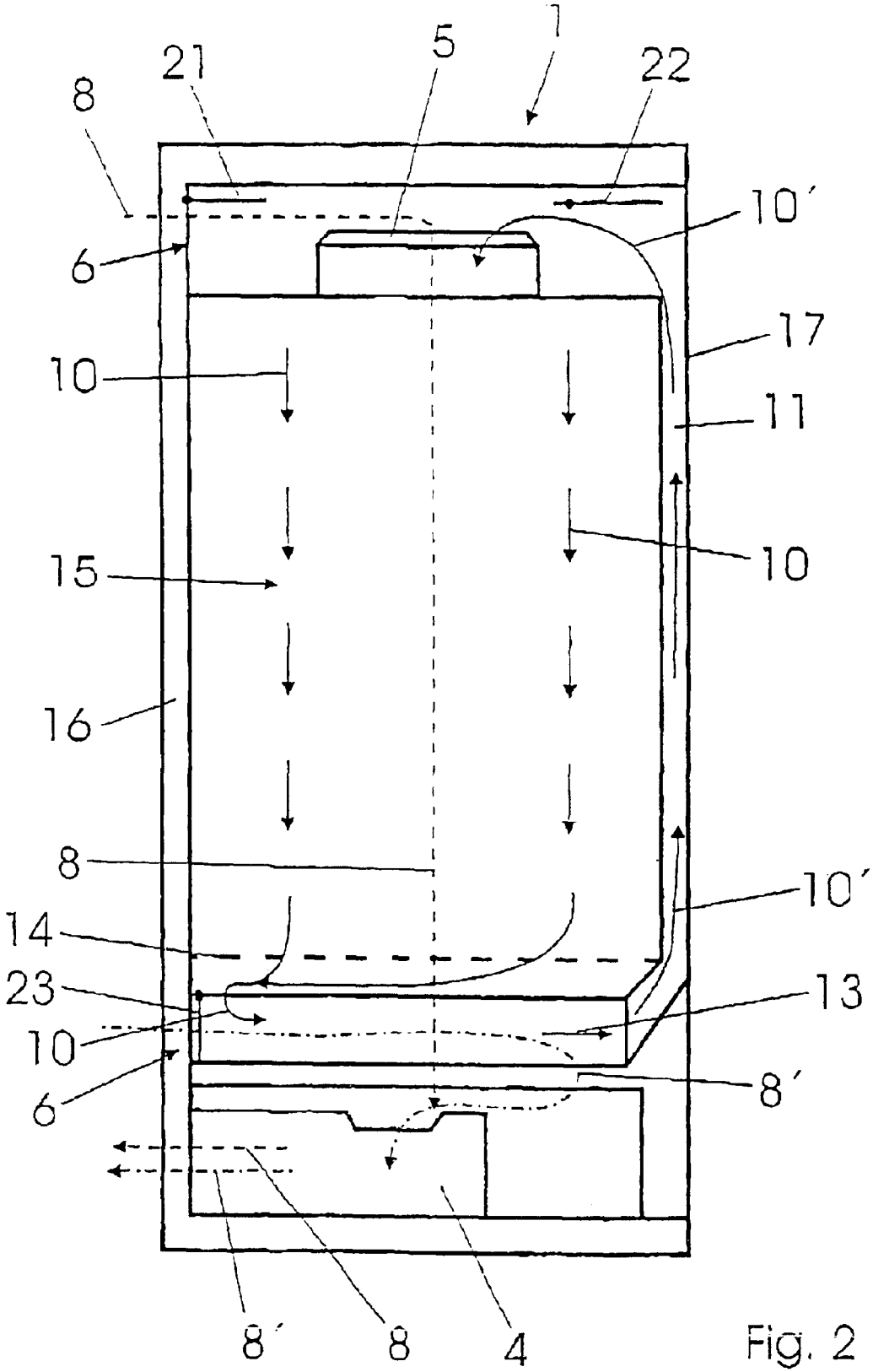
Figure 3:
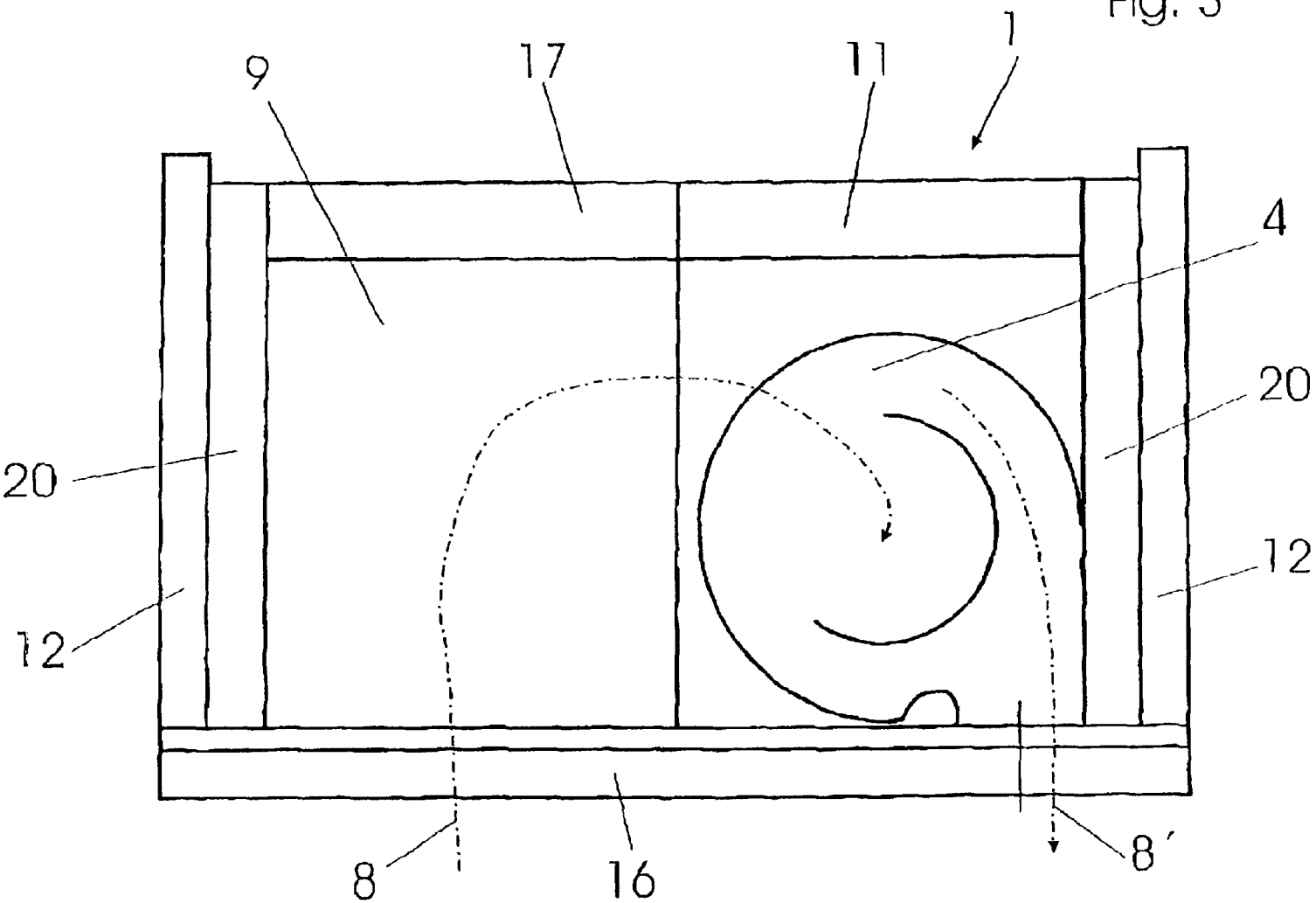
Figure 4:
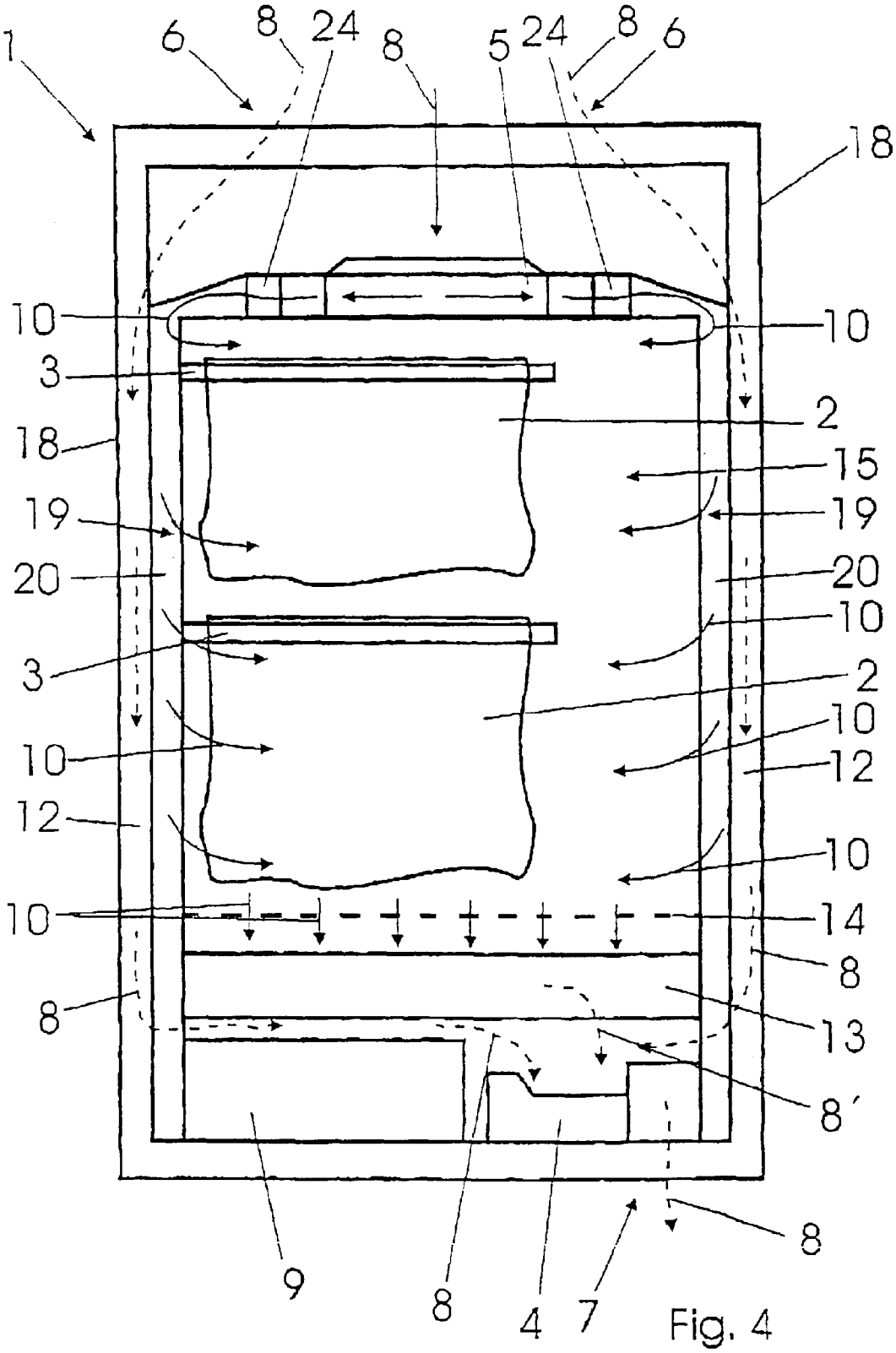
Figure 5:
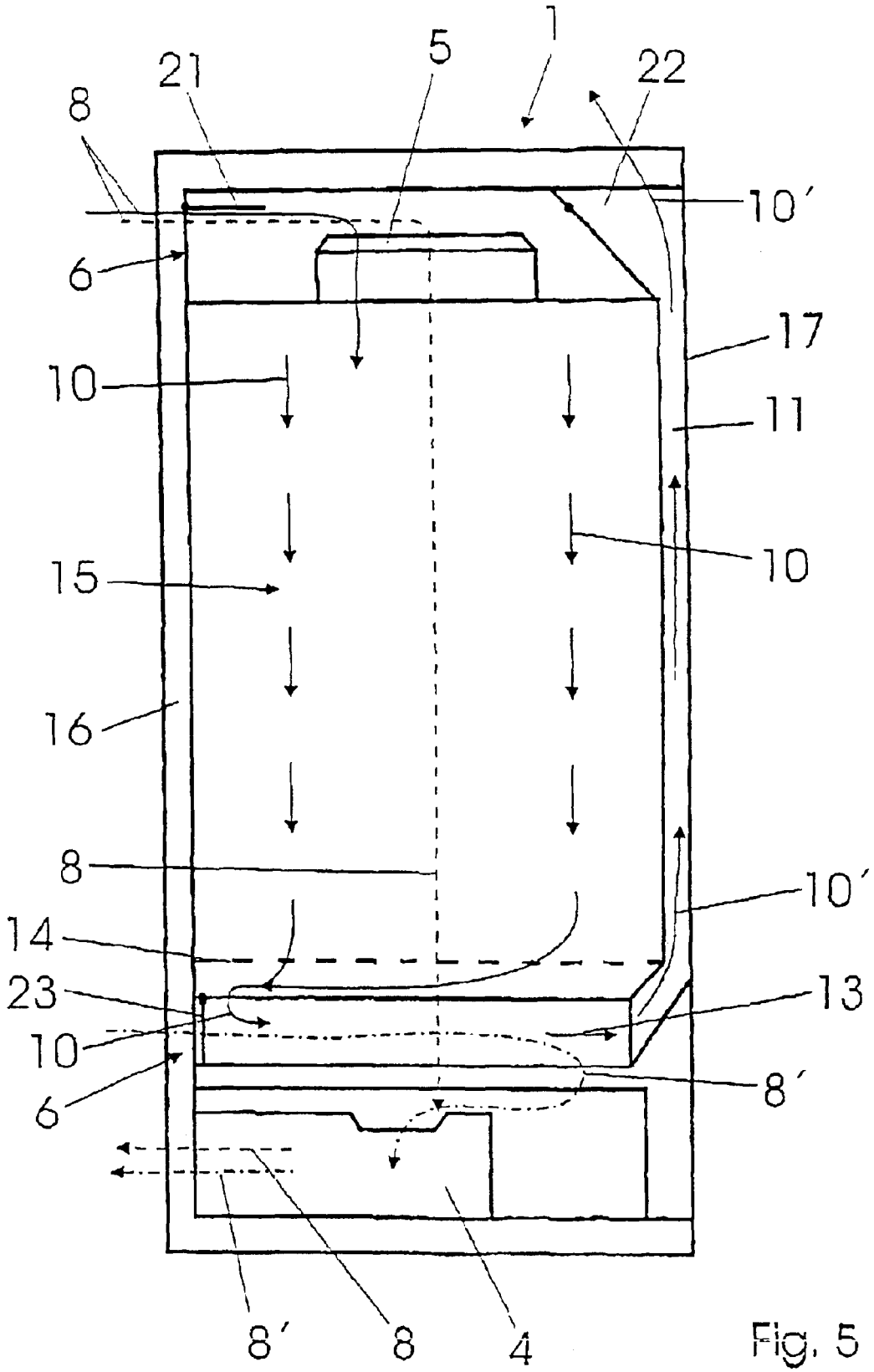

FIG. 1 —a front view of the drying cabinet according to the invention in the open state in a broken-out section with streams of air indicated by means of arrows, FIG. 2 —a side view of a drying cabinet according to the invention according to FIG. 1 in the cut, FIG. 3 —a supervision on a cut of the drying cabinet in the area of the base according to FIGS. 1 and 2, FIG. 4 —a front view of a drying cabinet according to the invention according to FIG. 1 with outlet flaps in the open circulation, FIG. 5 —a side view of a drying cabinet according to the invention according to FIG. 4 with outlet flaps in the open circulation.

The drying cabinet 1 according to the invention is represented in FIGS. 1 to 3 in a first configuration at which a drying of the material 2 only indicated schematically is carried out inside the treatment chamber 15 of the drying cabinet 1. The material 2, here only indicated as laundry pieces hangs on on-hanging devices 3 which aren't represented more exactly and known in principle, which are fastened approximately horizontally inside the treatment chamber 15 of the drying cabinet 1. The fundamental construction and the air guide of the drying cabinet 1 according to FIG. 1 corresponds to the one from the patent issue DE 42 35 560 C2 of the same inventor.

Above the treatment chamber 15 a ventilator 5 is indicated for the warm steam of air 10, 10' which leads as a radial blast the warm steam of air 10 via appropriate air guides into respective channels 20 which form an air guide limiting the treatment chamber 15 approximately vertically. In these channels 20 lateral openings 19 at the side open to the inside of the treatment chamber 15 by which warm steam of air 10 can enter the inside of the treatment chamber 15 by which the warm steam of air 10 can enter the inside of the treatment chamber 15 streaming contrary to each other and from the two sides of the drying cabinet 1. Through this a good mixture of the inside of the treatment chamber 15 with the warm stream of air 10 is reached by which the material 2 can hand in humidity.

The warm steam of air 10 is supplied to a condenser 13 after the passage through the treatment chamber 15 through a perforated lower wall 14 and taken in this condenser 13 into a thermal connection with a cold stream of air explained still more precisely. After the passage through the heat exchanger 13 the warm steam 10 cooled down streams up again towards the blast 5 through an air duct 11 on the back side of the drying cabinet and is blown once more into the inside of the treatment chamber 15 as already described. The particularly advantageous drying of the material 2 is made possible because of this stream of air of the warm stream of air 10, 10' led in the closed circulation is still more precisely described way so that a follow-up treatment by ironing can be avoided.

The condenser 13 below the treatment chamber 15 is cooled with a first cold stream of air 8 as well as a further cold stream of air 8' and leads to condensing the degree of humidity contained in a warm stream of air 10. The cold stream of air 8' is drawn in about an intake 6 nearby the condenser 13 from the surrounding in which below the condenser 13 a radial blast in form of a ventilator 4 causes the corresponding stream of air. The ventilator 4 ejects the cold stream of air 8 again over the exhaust port 7 in the base area of the drying cabinet 1. The other part 8' of the cold stream of air is also drawn in from the surrounding above the treatment chamber 15 and letdown towards the ventilator 4 by air ducts 12 positioned between the covers 18 and the channel 20. This air guide helps that the surfaces of the drying cabinet 1 which can be touched by operating persons are cooled at the same time so that these persons are not able to burn at the otherwise hot surfaces. The cold stream of air 8' decrease the temperature being on the outside of the air ducts 20 because of the warm stream of air 10.

Below the condenser 13 and in connection with this by means of a corresponding liquid conductive is the collecting basin 9 for the condensed liquid which is calculated appropriately generously and makes possible for the collecting basin 9 an easily transporting of the caught liquid into a sink or the like also without slopping over. The liquid dried out from the material 2 is caught in this and taking by the operating person after completion of the drying process.

Two flaps 21, 22 can be recognized in the upper area of the drying cabinet 1 of which the flap 22 represents an outlet flap of the warm stream of air 10 in the open circulation which is explained in the FIGS. 4 and 5 still more precisely. In the configuration represented in the FIGS. 1to 3 this flap 22 is closed so that the warm stream of air 10 is supplied to the ventilator 5 again after passing through the channel 11. The flap 21 serves for the seal of the air supply for the cold stream of air 8', which can enter between the treatment chamber 15 and the covers 18 of the drying cabinet 1 in the upper area of the drying cabinet 1 and be conveyed by the ventilator 4 downwards. In the operating state of the drying cabinet 1 in which the condenser 13 is not operating this flap 21 just like the flap 23 near the condenser 13 can be locked so that the cooling stream of air 8, 8' in the drying cabinet 1 can be turned off completely. To this the ventilator 4 is also set out of operation, for example. In this operating state an on-heating of the treatment chamber 15 is made by merely by heating elements 24 which are positioned in the upper part of the drying cabinet 1 and not described here more precisely. By this an atmosphere develops saturated very much with steam inside the treatment chamber 15 in the closed circulation which with regard to the crease and fold free drying of the material 2 leads to the still more precisely described advantages.

The operation of the drying cabinet 1 according to the method according to the invention can approximately be described as follows. The laundry 2, for example still humid from a previous stage out of the washing is hung at the on hanging devices 3 into inside of the treatment chamber 15, in which by the occupancy of the treatment chamber 15 a very good volume usage with laundry pieces 2 of the drying cabinet 1 can be reached. Of course it can also be thought to bring in not previously washed laundry, but the laundry or the like which is damp or creased in another way caused by ecological damages or the like which shell be in an non-iron and dry state before either. Example of such a material can be a variety of objects used in the household as sensitive fabrics, pure wool, quilts, cushions, duvets, blankets, leather shoes and arbitrary further objects, this one be subject to a damp load or be moistened for cleaning purposes.

After bringing in the material 2 the door 16 represented the front side of the drying cabinet 1 is closed and the drying cabinet 1 is switched into a first operating state in which the heating elements 24 as well as the ventilator 5 for the stream of air 10, 10' are set into operation. The air guide is realized in the above mentioned way in a closed circulation so that the warm stream of air 10, 10' is conveyed after passing the treatment chamber 15 over the condenser 13 and already be in operation in this operating state by cooling the cold stream of air 8, 8' and switching on of the ventilator 4 so that humidity can be removed from the inside of the treatment chamber 15 already immediately during the on-heating of the treatment 15. It is of course also conceivable not to set the condenser 13 into operation for the other process cycle during this heating up phase yet so no cold stream of air 8, 8' is taken into contact in the condenser 13 with the warm stream of air 10, 10'. It is favourably, for example, to set the condenser 13 into operation only after a particular heating time so that fast a high quota of air humidity in the warm stream of air 10, 10' results and the material 2 therefore fast can be relaxed non-crushably.

The effect of the warm stream of air 10, 10' in this phase is based on the process cycle that during the contact e.g. textile materials with a steam stream the fibres of these textile materials are relaxed and hereby perhaps existing creases, folds or the like not smooth regions are removed without a mechanical action. In principle, this effect is approximately known from the field of ironing technology in which so-called steam showers are appropriate at the iron as an additional function, which the ironing person places before the mechanical contact of the iron specifically on to determined regions to be ironed and which causes a pre-humidifying and thus just a relaxing of a fabric already described. In the operation of a drying cabinet 1 described here a complete material 2 is treated by such a steam shower by means of the high steam amount in the warm stream of air 10, 10', so that a local application of specific steam quantities is not required at all. The laundry 2 hung up on the on hanging devices 3, which can be normally hung up quite smoothly loses the appropriate creases through this and then can be taken from the drying cabinet 1 after a following drying completely or furthest-reaching crease and fold freely. A complete work cycle of the material 2 can be saved after the drying by this through which a high time relief of approximately a housewife is attainable.

After a period of time of the action of the air-/steam mixture within the treatment chamber 15 in the way already described which is possibly eligible dependent on the laundry and the respective humidity ratio the condenser 13 is set into operation withdraws step by step the humidity of the warm stream 10, 10', so that the laundry 2 is dried increasingly. The closed circulation of the drying cabinet 1 according to the invention has the great advantage that no humid output air stream leaves the drying cabinet 1. this humid output air stream, for example, causes possible humidity damages at the assembly in an apparent within the rooms, and therefore, as a rule, must be disposed by an appropriate output air guide at the open. The condensate generated at the condenser 13 is conducted over corresponding conducting devices of the condenser 13 into an on-catch container 9 and can be taken collectedly there after completion of the drying process.

It is another advantage of the represented operation of the drying cabinet 1 according to the invention that the steam is won itself from the damp of the drying material 2 partly or completely whereby a partial drying of material 2 is on the one hand already reached during the extraction of the steam and the drying time is altogether therefore shortened. On the other hand, such an operation is advisable with regard to the energy quantities being used since an external extraction of steam for example by a steam generator is avoidable and the energy causes a drying effect for winning the steam simultaneously.

In the FIGS. 4 and 5 an opening state of the drying cabinet 1 corresponding to the construction of the drying cabinet 1 of the figures 1 to 3 is represented at which an additional work cycle, for example such as disinfecting, airing or the like is attached after the completion of the drying process at which the drying cabinet 1 is operated in the open circulation. The air guide already known in principle for this operating state according to DE 42 35 560 C2 of such a drying cabinet is realized in the way which is represented here and according to the invention in the same drying cabinet 1 by the fact that the output air flap 22 for the warm stream of air 10 is open now as it is to recognize in FIG. 5. Through this the warm stream of air 10' can be carried away completely or partly to the surrounding, so that after passing the inside of the treatment chamber 15 the warm stream of air 10' is conducted out completely or partly. At the same time, at the top of the drying cabinet 1 a corresponding cold stream of air 8, 8' is led into the area of the ventilator 5, which after passing on the heating elements 24 can replace the conducted out part of the warm stream of air 10'. By this mixture of the warm stream of air 10' with the cold stream of air 8' an exchange of a stream of air circulating arises which can be of use, for example, for airing, but also fast cooling down the treatment chamber 15. Is the humidity content of the warm stream of air 10' leaving at the flap 22 after the far-reaching drying of the material 2 only small, so also the load of the surrounding due to humidity is small and herewith it is possible, for example, to carry out further confessed treatment steps like disinfecting, sterilizing, airing or the operation of the drying cabinet 1 for the removal of pollutants in the open circulation. The opening of the flap 22 or the corresponding elements to the air guide of the cold stream 8' of air can of course be controlled by time, by temperature or depending on other state quantities of the material 2 to be dried.

Number List

1—drying cabinet
2—material/laundry
3—on hanging devices
4—ventilator cold stream of air
5—ventilator warm stream of air
6—intake cold stream of air
7—outlet cold stream of air
8, 8'—cold stream of air
9—collecting basin
10, 10'—warm stream of air
11—air duct backwash warm stream of air
12—air duct cooling stream of air
13—heat exchanger/condenser
14—lower wall treatment chamber
15—treatment chamber
16—door drying cabinet
17—rear drying cabinet
18—covers drying cabinet
19—lateral intakes
20—air duct warm stream of air
21—intake flap cold air
22—outlet flap warm air
23—supplied surrounding air
24—heating elements.

What is claimed is:

1. A method for the drying of a damp material (2), in particular of damp laundry, whereby the material (2) is treated in a treatment chamber (15) of a drying cabinet (1) in mechanically immobile condition in which air (10) is directed through the treatment chamber (15) and over a condenser (13), which is cooled by an outer air circuit, and the moisture in the air (10) condenses on the condenser (13) and can be led away, characterised in that the air (10) is circulated over the material (2) for drying at least during a period of the drying of the material (2) with a switched-off condenser in a closed inner loop through the treatment chamber (15) in which the material (2), which is hung by means of an on hanging device (3), is exposed at increasing temperature in the treatment chamber (15) to steam or increased humidity generated at least partly from the dampness of the material (2) or the increased humidity of the air (10) circulating around with a temperature up to between 90 degrees Celsius and 125 degrees Celsius and is relaxed and smoothed by the steam or the increased humidity in relation to creases, or folds from preceding treatments, and with an increasing dehumidify of the residual humidity of the air (10) after the beginning of the condensation at the condenser (13) the material (2) then is freed of creases, or folds and therefore is then dried largely without ironing.

2. A method according to claim 1, characterised in that during the formation of the steam or the increased humidity the temperature is increased in the treatment chamber (15).

3. A method according to claim 1, characterised in that the condensation starts after a time delay after the beginning of the drying and the generation of the steam or the increased humidity.

4. A method according to claim 1, characterised in that the change-over from the transition of the steam or the increased humidity over the material (2) in the closed circulation to the phase of the increasing withdrawal of the air humidity from the treatment chamber (15) by means of condensation at the condenser (13) is carried out slidingly.

5. A method according to claim 1, characterised in that the air (10) and/or steam or increased humidity after the transition over the condenser (13) in operation mode amounts maximum for about 60–70 degrees celsius.

6. A method according to claim 1, characterised in that the steam or the increased humidity is at least partly supplied also from an external source to the treatment chamber (15).

7. A method according to claim 1, characterised in that the after the phase of the transition of the steam or the increased humidity and at or after the drying the material (2) is exposed in the same treatment chamber (15) in an open circulation under influence of external air (23) supplied from the outside to a further treatment like a further drying, a disinfection, a sterilization, a pollutant removal or the like.

8. A method according to claim 7, characterised in that by means of the addmix of external air (23) into the treatment chamber (15) the temperature in the treatment chamber (15) can be reduced.

* * * * *

UNITED STATES PATENT AND TRADEMARK OFFICE

CERTIFICATE OF CORRECTION

PATENT NO. : 6,796,055 B2
DATED : September 28, 2004
INVENTOR(S) : Baltes

It is certified that error appears in the above-identified patent and that said Letters Patent is hereby corrected as shown below:

Column 8,
Lines 26 and 30, please change “creases, or” to correctly read: -- creases or --.

Signed and Sealed this

Eighth Day of February, 2005

JON W. DUDAS
*Director of the United States Patent and Trademark Office*